US005259144A

United States Patent [19]

Yeh

[11] Patent Number: 5,259,144

[45] Date of Patent: Nov. 9, 1993

[54] PLANETARY-TYPE LAPPING DEVICE FOR FINISH-GRINDING THE VALVE SEAT OF A SAFETY RELIEF VALVE

[76] Inventor: Wen-An Yeh, No. 10, Lane 100, Nan-Ho St., Feng-Shan City, Kaohsiung Hsien, Taiwan

[21] Appl. No.: 931,145

[22] Filed: Aug. 17, 1992

[51] Int. Cl.[5] ..... B24B 15/02

[52] U.S. Cl. ..... 51/120; 51/241 A

[58] Field of Search ..... 51/120, 241 VS, 241 S, 51/241 B, 241 A, 90

[56] References Cited

U.S. PATENT DOCUMENTS

| | | | |
|---|---|---|---|
| 1,819,543 | 8/1931 | Barber | 51/241 A |
| 1,941,918 | 1/1934 | Schwakopf | 51/241 A |
| 2,649,669 | 8/1953 | Tobis | 51/241 A |

FOREIGN PATENT DOCUMENTS

| | | | |
|---|---|---|---|
| 0407186 | 3/1934 | United Kingdom | 51/241 A |

*Primary Examiner*—Robert A. Rose

*Attorney, Agent, or Firm*—Matthew K. Ryan, Curtis Morris & Safford, P.C.

[57] ABSTRACT

A planetary-type lapping device is used to finish-grind the surface of the valve seat of a safety relief valve and includes a gear housing which confines a gear receiving space. The gear housing has a top end with a rotatable axial shaft which extends upwardly therefrom and a bottom end. A primary gear member is mounted rotatably to the gear housing in the gear receiving space. At least one secondary gear unit is provided in the receiving space and meshes with the primary gear member. Each secondary gear unit is provided with an axle that is mounted rotatably to the gear housing and that has a lower end which extends downwardly through the bottom end of the gear housing. A grinding disc is mounted on the lower end of the axle of each secondary gear unit. Each grinding disc has a lower side formed with a grinding compound.

3 Claims, 4 Drawing Sheets

PLANETARY-TYPE LAPPING DEVICE FOR FINISH-GRINDING THE VALVE SEAT OF A SAFETY RELIEF VALVE

BACKGROUND OF THE INVENTION

1. Field of the Invention

The invention relates to a lapping device for a safety relief valve, more particularly to a planetary-type lapping device for finish-grinding the valve seat of a safety relief valve.

2. Description of the Related Art

A safety relief valve is usually installed in a container, such as a boiler or a compressed gas receiver and is set to open at a predetermined pressure so as to avoid bursting of the container. A high degree of precision is required when manufacturing or repairing the safety relief valve so as to prevent the leakage of fluids, such as steam or gas, from the container. Because of the high degree of precision which is required when manufacturing or repairing the safety relief valve, the safety relief valve therefore has a relatively high manufacturing cost.

Prolonged use of the safety relief valve usually results in a rough, uneven surface at the valve seat of the safety relief valve. Since replacement of the safety relief valve entails a large additional cost, the surface of the valve seat is usually finish-ground in order to prolong the useful life of the same.

FIG. 1 is an illustration of a conventional lapping device (1) for finish-grinding the valve seat (92) of a conventional safety relief valve (90). The lapping device (1) includes an upwardly extending handle (11), a disc member (14) provided on a lower end of the handle (11) and a positioning rod (12) which extends downwardly from the disc member (14). Grinding projections (13) are provided on a lower side of the disc member (14).

The positioning rod (12) is extended into a valve opening (91) that is defined by the valve seat (92) when the lapping device (1) is used to finish-grind the surface of the valve seat (92). The grinding projections (13) are in contact with the valve seat (92) at this stage. The handle (11) is then rotated manually, thereby permitting the grinding projections (13) to lap the surface of the valve seat (92).

The disadvantages of using the lapping device (1) for finish-grinding the valve seat (92) are as follows:

1. The lapping device (1) is manually operated, requires the application of a relatively large force and further requires a relatively large operating space so as to facilitate proper operation the same.

2. Since the lapping device (1) is rotated about an axis which is coaxial with the axis of the valve seat (92), frequent finish-grinding of the surface of the valve seat (92) can result in the formation of annular grinding grooves thereat. These grinding grooves can affect the precision of the safety relief valve.

3. Since the lapping device (1) is manually operated and since the force which is exerted when the lapping device (1) is operated is not constant, the surface of the valve seat (92) remains uneven and may be slanted when finish-ground. This can result in the untimely release of high pressure fluids.

SUMMARY OF THE INVENTION

Therefore, the main objective of the present invention is to provide a planetary-type lapping device which can overcome the above-mentioned drawbacks that are commonly associated with the previously described conventional lapping device.

Another objective of the present invention is to provide a planetary-type lapping device for finish-grinding the valve seat of a safety relief valve, which lapping device can be electrically driven so as to reduce the required manpower while achieving a high degree of precision.

Accordingly, the preferred embodiment of a planetary-type lapping device of the present invention comprises:

a gear housing which confines a gear receiving space, said gear housing having a top end with a rotatable axial shaft which extends upwardly therefrom and a bottom end;

a primary gear means mounted rotatably to the gear housing in the gear receiving space;

at least one secondary gear unit provided in the receiving space and meshing with the primary gear means, each secondary gear unit being provided with an axle that is mounted rotatably to the gear housing and that has a lower end which extends downwardly through the bottom end of the gear housing; and a grinding disc mounted on the lower end of the axle of each secondary gear unit, each grinding disc having a lower side formed with a grinding compound.

The primary gear means is adapted to be mounted statically to a safety relief valve. The axial shaft is axially rotated to rotate the gear housing and cause each secondary gear unit to revolve around the primary gear means. Revolution of the secondary gear unit around the primary gear means causing axial rotation of the former. The grinding disc rotates with the respective secondary gear unit to permit the grinding compound to lap the surface of a valve seat of the safety relief valve.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
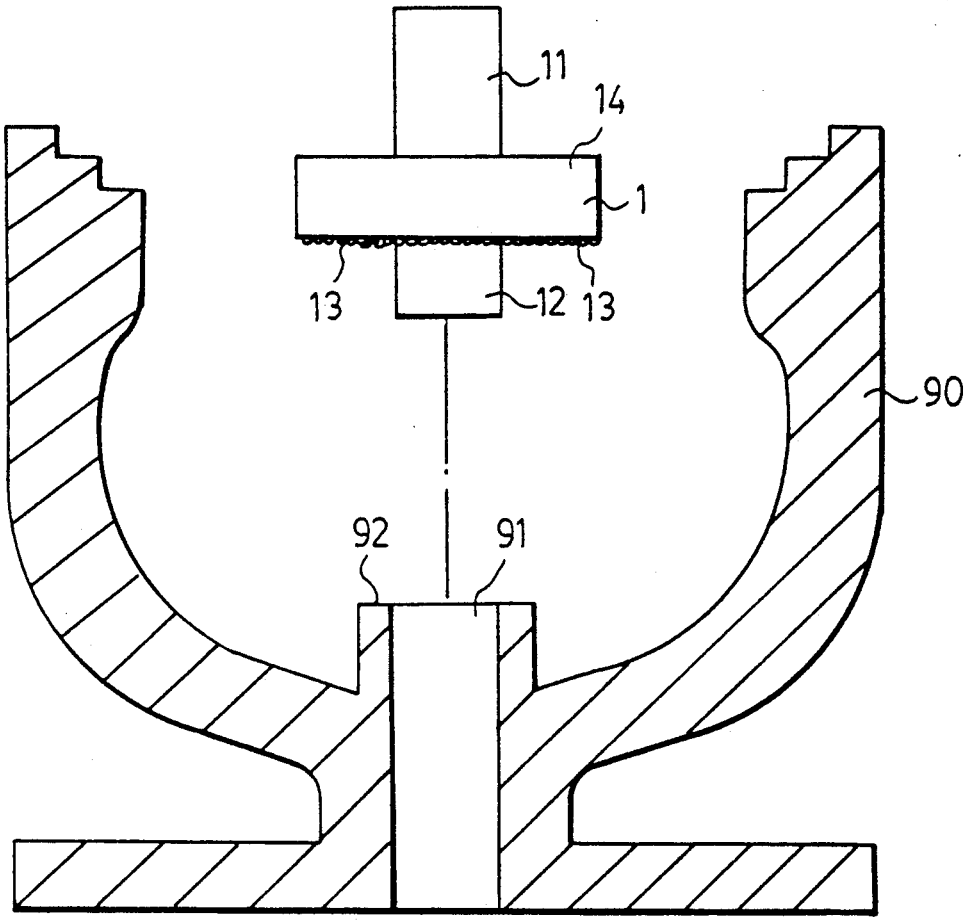
FIG. 1 PRIOR ART
FIG. 1 is an illustration of a conventional lapping device for finish-grinding the valve seat of a safety relief valve.
Figure 2:
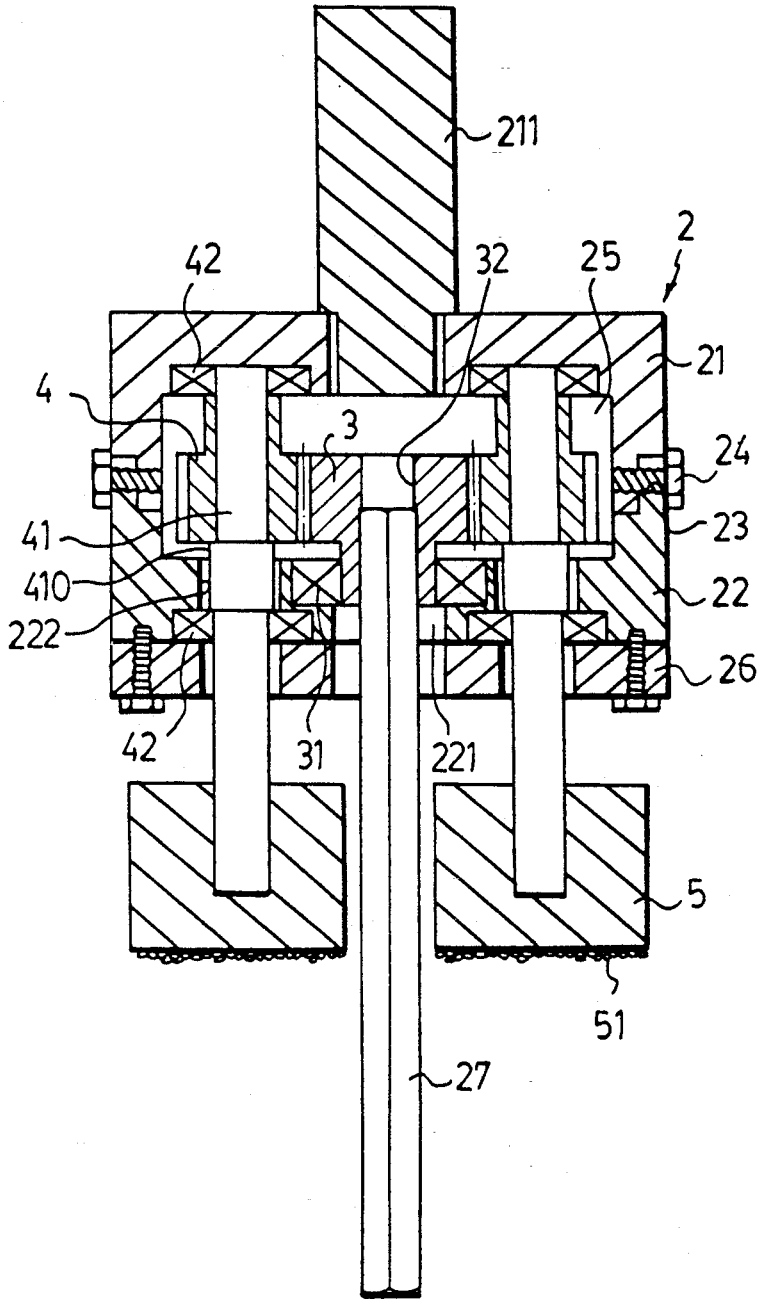
FIG. 2 is a sectional view illustrating the assembly of the preferred embodiment of a planetary-type lapping device according to the present invention.

Referring to FIG. 2, the preferred embodiment of a planetary-type lapping device according to the present invention is shown to comprise a gear housing (2), a primary gear member (3), a plurality of secondary gear units (4) and a plurality of grinding discs (5).

The gear housing (2) includes an upper housing part (21) and a lower housing part (22). The lower end of the upper housing part (21) and the upper end of the lower housing part (22) are fittingly engaged and are provided with a plurality of aligned screw holes (23) to receive screws (24). A rotatable axial shaft (211) extends upwardly from the upper housing part (21). The upper and lower housing parts (21, 22) cooperatively confine a receiving space (25) to receive the primary gear member (3) and the secondary gear units (4). The lower end of the lower housing part (22) is formed with a central hole (221) and a plurality of through holes (222) which are offset from the central hole (221). A support plate (26) is mounted on the bottom side of the lower end of the lower housing part (22). The support plate (26) is formed with a plurality of holes that are respectively aligned with the central hole (221) and the through holes (222).

A roller bearing unit (31) is mounted on the lower end of the lower housing part (22). The primary gear member (3) has a diameter-reduced lower end which is mounted to the inside of the roller bearing unit (31). The roller bearing unit (31) permits the rotation of the gear housing (2) relative to the primary gear member (3). The primary gear member (3) is provided with an axial positioning hole (32) which is hexagonal in cross-section and which is aligned with the central hole (221). The top end of a positioning rod (27) is fittingly received in the positioning hole (32).

Each of the secondary gear units (4) meshes with the primary gear member (3) and is provided with an axle (41). A plurality of bearing units (42) are provided on the upper and lower housing parts (21, 22) in order to mount the axle (41) of the secondary gear units (4) rotatably onto the gear housing (2). The lower end of each axle (41) extends downwardly through a corresponding through hole (222) in the lower housing part (22). Each axle (41) is further provided with a radial flange (410) which rests on a corresponding bearing unit (42) on the lower housing part (22). The radial flange (42) is used to position the respective axle (41) properly in the receiving space (25).

Each of the grinding discs (5) is mounted axially on a distal lower end of a respective one of the axles (41). Each of the grinding discs (5) has a lower side which is provided with a grinding compound (51).

Figure 3:
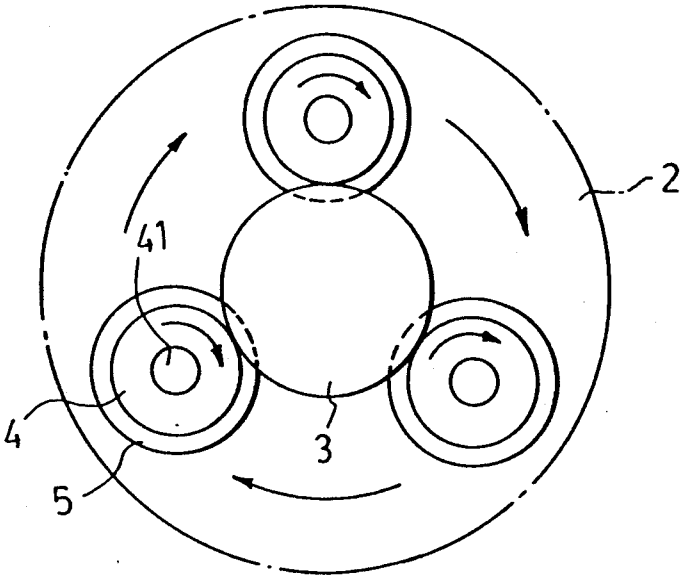
FIG. 3 illustrates the movement of secondary gear units relative to a primary gear member of the preferred embodiment.

Referring to FIG. 3, which illustrates how the secondary gear units (4) move relative to the primary gear member (3), and to FIG. 2, the primary gear member (3) is in a static state when the preferred embodiment is in operation. When the gear housing (2) is rotated in a clockwise direction, the secondary gear units (4) move with the gear housing (2) so as to revolve around the primary gear member (3). Since the secondary gear units (4) are meshed with the primary gear member (3), revolution of the secondary gear units (4) relative to the primary gear member (3) can cause the former to rotate axially in a clockwise direction. Therefore, the secondary gear units (4) simultaneously rotate axially and revolve around the primary gear member (3).

Figure 4:
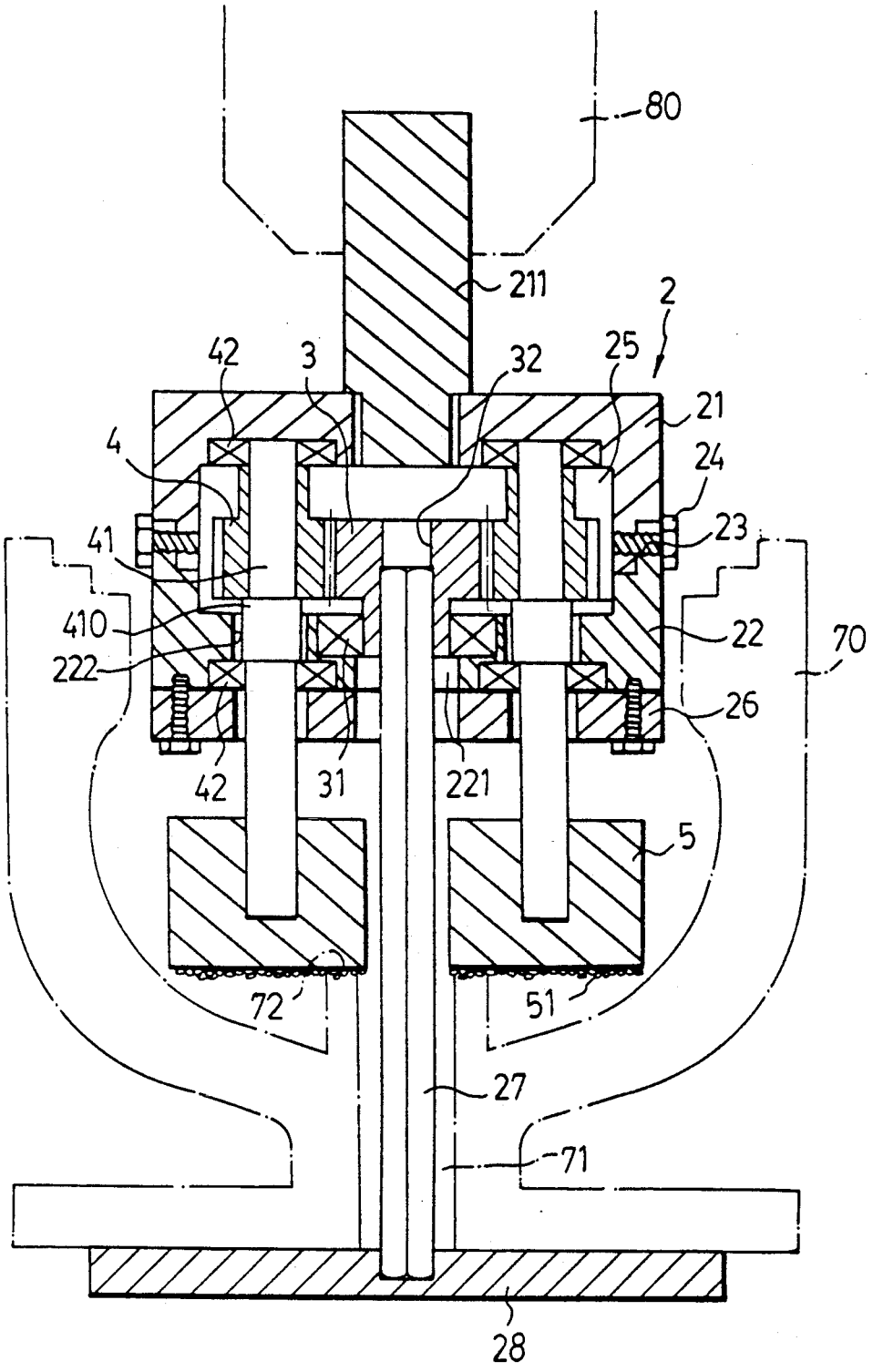
FIG. 4 is an illustration of the preferred embodiment when used to finish-grind the valve seat of a safety relief valve.

FIG. 4 is an illustration of the preferred embodiment when used to finish-grind the valve seat (72) of a safety relief valve (70). The top end of the positioning rod (27) is fitted into the positioning hole (32) of the primary gear member (3), while the lower end of the same is extended through a valve opening (71) that is defined by the valve seat (72). The grinding compounds (51) are in contact with the surface of the valve seat (72) at this stage. A clamp unit (28) is attached to the lower end of the positioning rod (27) and locks the positioning rod (27) onto the safety relief valve (70), thereby preventing the rotation of the primary gear member (3). The rotatable axial shaft (211) is then secured to the output end (80) of an automatic rotary driver (such as a drilling machine). Rotation of the output end (80) causes the axial shaft (211) and the gear housing (2) to rotate correspondingly, thereby causing axial rotation of the secondary gear units (4) and the grinding discs (5) while revolving around the primary gear member (3). Rotation of the grinding discs (5) permits the grinding compound (51) to lap the surface of the valve seat (92) so as to finish-grind the same.

Note that since the planetary-type lapping device of the present invention may be electrically driven, the movement of the grinding compound (51) and the force exerted by the same can be regulated. The lapping device of the present invention can therefore be used to provide a smooth and even finished surface. Furthermore, no annular grinding grooves are formed on the surface of the valve seat when the lapping device of the present invention is in use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A planetary-type lapping device for finish-grinding the surface of the valve seat of a safety relief valve, said lapping device comprising:

a gear housing which confines a gear receiving space, said gear housing having a top end with a rotatable axial shaft which extends upwardly therefrom and a bottom end, a primary gear means mounted rotatably to said gear housing in said gear receiving space;

at least one secondary gear unit provided in said receiving space and meshing with said primary gear means, each said secondary gear unit being provided with an axle that is mounted rotatably to said gear housing and that has a lower end which extends downwardly through said bottom end of said gear housing; and a grinding disc mounted on said lower end of said axle of each said secondary gear unit, each said grinding disc having a lower side formed with a grinding compound;

said primary gear means being mounted statically to the safety relief valve, said axial shaft being axially rotated to rotate said gear housing and cause each said secondary gear unit to revolve around said primary gear means, revolution of said secondary gear unit around said primary gear means causing axial rotation of said secondary gear unit, said grinding disc rotating with the respective said secondary gear unit to permit said grinding compound to lap the surface of the valve seat, said primary gear means further comprises:

a gear member mounted rotatably to said gear housing and being formed with an axial positioning hole; and a positioning rod having a top end which is fittingly received in said positioning hole and a lower end which extends through said bottom end of said gear housing, said lower end of said positioning rod being adapted to extend through the valve seat and being adapted to be mounted statically to the safety relief valve.

2. The planetary-type lapping device as claimed in claim 1, wherein said positioning hole is hexagonal in cross-section.

3. The planetary-type lapping device as claimed in claim 1, further comprising at least one bearing unit rotatably mounting said lower end of a respective said secondary gear unit to said bottom end of said gear housing, said axle of each said secondary gear unit being provided with a radial flange which rests on the respective said bearing unit to position said secondary gear unit properly in said receiving space.

* * * * *